United States Patent [19]

Talbot

[11] Patent Number: 4,716,701

[45] Date of Patent: Jan. 5, 1988

[54] ROOF SYSTEM BASED ON TWO TILE ELEMENTS HAVING MEANS OF ATTACHMENT

[76] Inventor: Michel Talbot, 127, Rue d'Estiennes d'Orves, Verrieres-le-Buisson, France, 91370

[21] Appl. No.: 760,301

[22] Filed: Jul. 29, 1985

[30] Foreign Application Priority Data

Jul. 30, 1984 [FR] France ..... 84 12052

[51] Int. Cl.[4] ..... E04D 1/00

[52] U.S. Cl. ..... 52/536; 52/542; 52/554

[58] Field of Search ..... 52/518, 519, 523, 524, 52/526, 536, 539, 542, 543, 546, 554, 84

[56] References Cited

U.S. PATENT DOCUMENTS 544,770 8/1895 Plympton ..... 52/519

2,084,609 6/1937 Corcoran ..... 52/546

FOREIGN PATENT DOCUMENTS 32321 7/1981 European Pat. Off. ..... 52/542

45289 3/1939 Netherlands ..... 52/542

465189 7/1935 United Kingdom ..... 52/546

2065741 7/1981 United Kingdom ..... 52/542

*Primary Examiner*—Carl D. Friedman

*Attorney, Agent, or Firm*—Darby & Darby

[57] ABSTRACT

A tile system includes a running tile having a flat bottom and parallel longitudinal edges, and a covering tile designed to rest on a pair of running tiles. The running tile has two notches formed in its parallel longitudinal edges, and the covering tile has a vertical partition that is adapted to engage the notches of adjacent running tiles to allow the lateral adjustment of the relative positions of the running tile and covering tiles.

7 Claims, 5 Drawing Figures

ROOF SYSTEM BASED ON TWO TILE ELEMENTS HAVING MEANS OF ATTACHMENT

The invention relates to the field of building roofs and more particularly to roofs of mechanical tiles.

One of the difficulties in laying tiles is the necessity of a very precise planning, that is to say, a determination with the greatest possible accuracy of the number of tiles to be used for a given roof, and, moreover, the figure for the relative spacing of the tiles in the direction of the slope, and transversely.

This operation is very important. In fact, if, as the tiles are being laid, it is found that the planning was poorly done, it is impossible with the tiles known today to take up the error by acting on the spacing of the tiles remaining to be laid. The tiles already laid have to be removed and the entire operation begun once again.

Very substantial sums have been invested both in France and elsewhere in attempts to find a solution to this difficulty, but these have up to now been unsuccesful.

The present invention procures a tile system which permits adjustment, while laying is in progress, of the spacing of the tiles relative to one another with retention of a good seal and which therefore permits correction of an error in planning.

With this in mind, the invention provides the use of a system of tiles with two components, namely, a "running" tile with flat bottom equipped with two longitudinal edges raised obliquely outward and a "covering" tile which is to rest with its longitudinal edges on a base of juxtaposed pairs of running tiles, the said system being characterized in that the running tile has two aligned notches on its edges, these notches cooperating with a transverse partition disposed close to one end of the covering tile.

Thus, by laterally sliding the two running tiles covered by the covering tile, it is possible to obtain a variation in the spacing between the point where the raised edges of two running tiles abut against one another and the point where they abut against the opposing lateral faces of the covering tile with which they cooperate.

According to an advantageous variation of embodiment, the lateral faces of the covering tile are notched at the end bearing the partition, to accommodate the super-position of the running tiles in the direction of the slope.

The height of the partition corresponds to that of the notches and the depth of the notches corresponds to the overlap of the tiles.

The running tiles also incorporate, on the lower face of their bottom, a spur to lock them on the battens of the roof.

Adjustment of the overlap of the tiles in the direction of the slope is therefore done by determining the spacing of the battens.

Close to its fower opening, the covering tile is equipped in known fashion with an aerodynamic bar in the form of two or more ribs.

It is shown in FIG. 5 that the combined length of projections of two longitudinal edges of the running tile on the roof is substantially smaller than a cord of an arc-shaped covering tile. Therefore, in an assembled condition of the system a substantial gap is provided between two adjacent running tiles.

Other characteristics and advantages of the invention will appear on reading the following description of an embodiment given with no limiting intent. The description will be presented with reference to the attached drawing in which.

Figure 1:
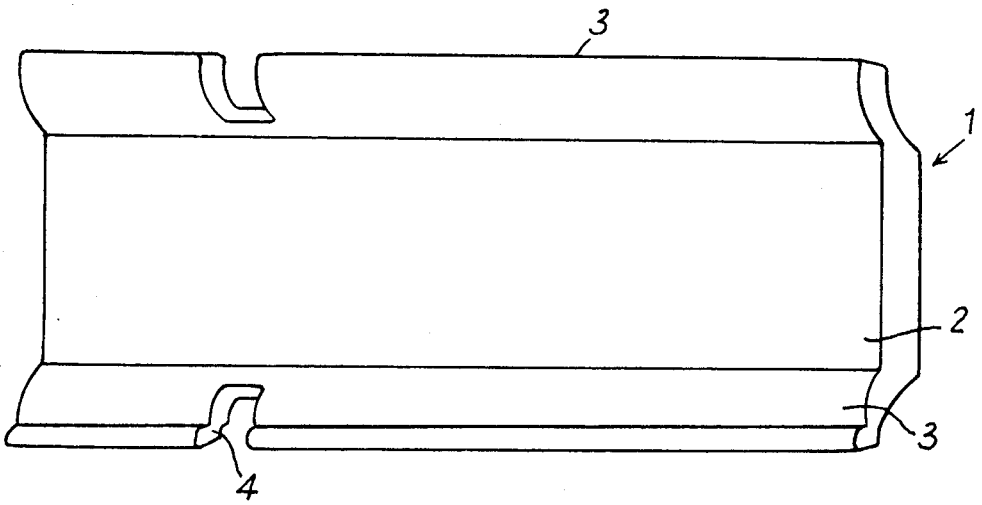
FIG. 1 is a perspective view from above of a running tile according to the invention.
Figure 2:
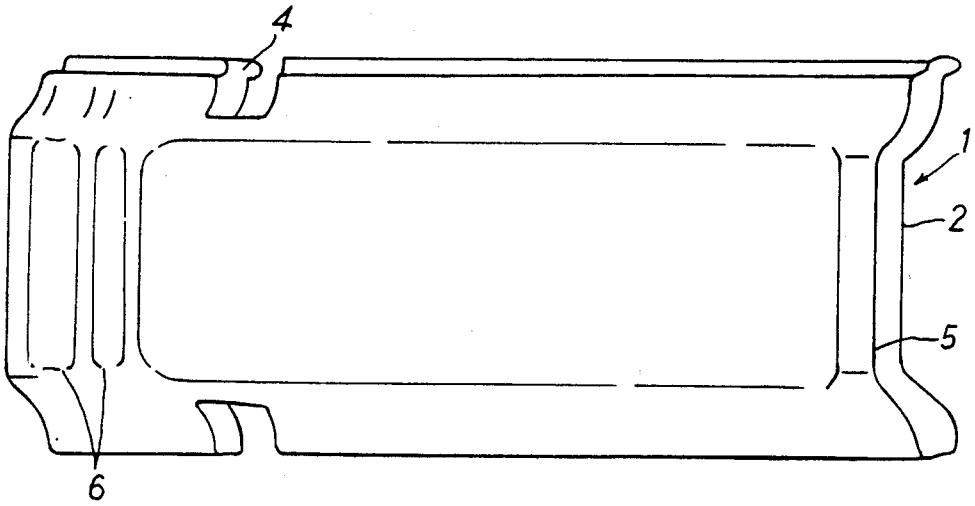
FIG. 2 is a perspective view from below of the tile in FIG. 1.

The running tile 1, represented in FIGS. 1 and 2, has a flat, rectangular bottom 2, equipped on its longitudinal sides with oblique edges 3, diverging outward and upward.

In the example represented, the oblique edges 3 have a convex curvature. This preferred form facilitates the unmolding of the tiles as they are manufactured.

At a point practically one third of its length from the base, each edge 3 has a notch 4 that extends almost to the bottom 2.

On its lower face, the running tile 1 also has, close to its upper end, a spur 5 locking the tile on the battens.

At its lower end, this lower face is equipped with two ribs 6 forming an aerodynamic bar.

Figure 3:
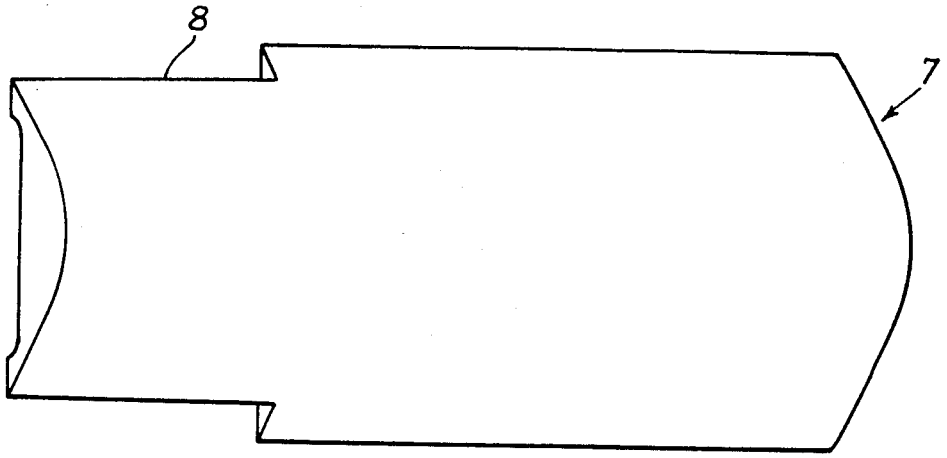
FIG. 3 is a perspective view from above of a covering tile according to the invention.
Figure 4:
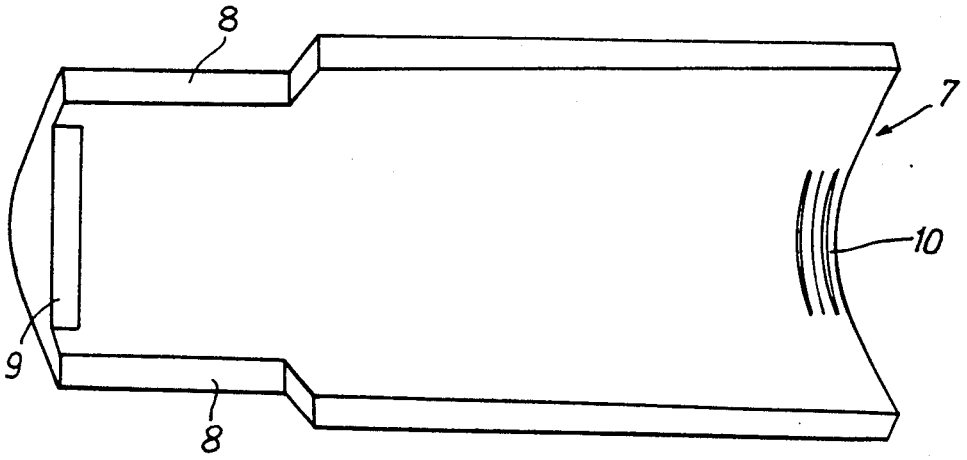
FIG. 4 is a perspective view from below of the tile in FIG. 3.
Figure 5:
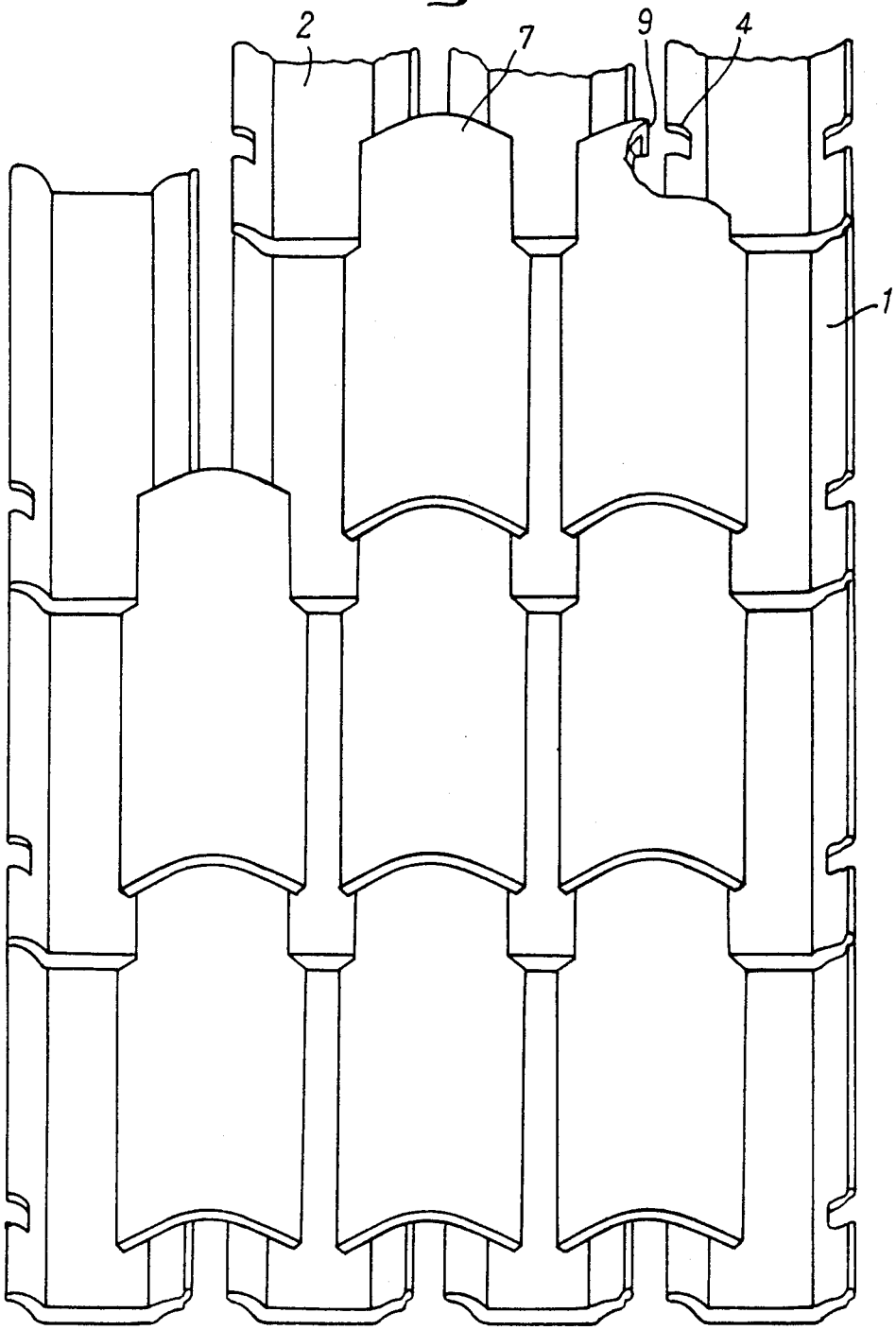
FIG. 5 is a perspective view of a fragment of roofing embodied with the tiles in the preceding figures.

The covering tile 7 represented in FIGS. 3 and 4 is semicircular in outer form. Close to its upper end, its flanks incorporate two cutouts 8, to accommodate the step constituted by two superposed running tiles.

In the plane of its rear end, the covering tile has a vertical partition 9, which is meant to lodge in the notches 4 of a running tile.

Close to the nose, on its lower face, the covering tile 7 also has two ribs 10 forming an aerodynamic bar.

The respective dimensions of the two elements are substantially as follows:

running tiles: H=420 mm, l=185 mm, covering tiles: H=420 mm, l=250 mm.

The notches 4 in the running tile 1 are placed at about 120 mm from the nose of the tile.

All of these dimensions are given by way of illustration, they can vary. In particular the emplacement of the notches 4 in the running tile 1 can be located at any desired point along edges 3, depending on the overlap selected as a function of the slope of the roof. Thus certain tiles 1 could have their notches 4 situated 90 mm from the nose, (slight overlap, sharp slope), others could be 150 mm (substantial overlap, gentle slope).

Likewise, partition 9 could be shifted to a greater or lesser degree inside covering tile 7.

And finally, the general form of both the covering and running tiles could be modified as a function of the type of roof to be constructed.

According to an advantageous variation of embodiment, not shown, the running tile can have a succession of notches 4 corresponding to the various overlaps in most common use.

I claim:

1. A tile system for use on sloped roofs comprising at least two running tiles adjacent to each other, each said running tile having a substantially rectangular shape and including a substantially flat bottom with longitudinal edges raised obliquely and substantially outwardly and upwardly from the substantially flat bottom, said edges having a curved convex configuration, the substantially flat bottom of the running tile having a lower face and a locking spur formed on its lower face, at least one covering tile of a substantially arc configuration, the covering tile being adapted to rest on the bottoms of said two running tiles juxtaposed and superposed in the direction of roof slope, the raised edges of the running tile having near an end of the running tile at least two notches spaced equally from the end, the covering tile having near an end thereof a substantially vertical partition for cooperating with said notches and permitting a spacing adjustment between the running tiles by relative sliding of the said notches along the partition, said substantially vertical partition substantially extending from one edge of the covering tile to the other edge, said partition is adapted to engage the notch of the running tile in any position on the full length of the partition, the combined length of projections of said two longitudinal edges of the running tile on the roof is substantially smaller than a cord of the arc of the covering tile so that in an assembled condition of the tile system a substantial gap is provided between said two adjacent running tiles providing a possibility of lateral movement between said running and covering tiles and allowing adjustment of the relative positions of the running tile and the covering tile.

2. Tile system according to claim 1 wherein the running tile has a series of notches, aligned on its raised edges.

3. Tile system according to claim 2, wherein the notches are disposed at 90, 120 and 150 mm from end of the running tile.

4. Tile system according to 1 wherein the notches are disposed at substantially one third of the height of the running tile from the end of the said tile.

5. Tile system according to claim 1 wherein the partition of the covering tile is disposed in the plane of the upper end.

6. Tile system according to claim 1 wherein the covering tile has, close to its upper end, two cutouts to accommodate the step constituted by the superposition of two running tiles.

7. Tile system according to claim 1 wherein the running tiles and the covering tile have ribs forming an aerodynamic bar.

* * * * *